United States Patent [19]

Heredy et al.

[11] 4,437,980

[45] Mar. 20, 1984

[54] MOLTEN SALT HYDROTREATMENT PROCESS

[75] Inventors: Laszlo A. Heredy, Canoga Park; Raymund P. Skowronski, Woodland Hills, both of Calif.

[73] Assignee: Rockwell International Corporation, El Segundo, Calif.

[21] Appl. No.: 403,693

[22] Filed: Jul. 30, 1982

[51] Int. Cl.[3] ..... C10G 49/02; B01J 23/92

[52] U.S. Cl. ..... 208/235; 208/251 H; 208/253

[58] Field of Search ..... 208/213, 209, 230, 251 H, 208/253, 235

[56] References Cited

U.S. PATENT DOCUMENTS

| | | | |
|---|---|---|---|
| 2,383,972 | 9/1945 | Jones | 23/22 |
| 2,788,081 | 4/1957 | Mills | 196/36 |
| 2,990,365 | 6/1961 | Bieber et al. | 208/253 |
| 3,164,545 | 1/1965 | Mattox | 208/230 |
| 3,449,242 | 6/1969 | Mattox et al. | 208/230 |
| 3,598,535 | 8/1971 | Wennerberg | 208/230 |
| 3,642,607 | 2/1972 | Seitzer | 208/8 |
| 3,677,932 | 7/1972 | Hardesty et al. | 208/108 |
| 3,736,250 | 5/1973 | Berg et al. | 208/10 |
| 3,745,109 | 7/1973 | Heredy et al. | 208/107 |
| 3,796,650 | 3/1974 | Urban | 208/10 |
| 3,846,275 | 11/1974 | Urban | 208/10 |
| 3,936,371 | 2/1976 | Ueda et al. | 208/251 H |
| 3,976,559 | 8/1976 | Bearden, Jr. et al. | 208/208 M |
| 4,003,823 | 1/1977 | Baird, Jr. et al. | 208/108 |
| 4,092,236 | 5/1978 | Heredy | 208/10 |
| 4,119,528 | 10/1978 | Baird, Jr. et al. | 208/108 |
| 4,160,721 | 7/1979 | Swanson | 208/230 |

*Primary Examiner*—Delbert E. Gantz
*Assistant Examiner*—Anthony McFarlane
*Attorney, Agent, or Firm*—Henry Kolin; Michael A. Kondzella; H. Fredrick Hamann

[57] ABSTRACT

A carbonaceous material is subjected to a hydrotreating process in which it is desulfurized, deasphalted and demetallized by reaction with hydrogen in a molten medium in the presence of potassium hydroxide and water. The water is present in an amount sufficient to minimize the formation of gaseous hydrocarbonaceous products but insufficient to significantly reduce the effectiveness of potassium hydroxide as the hydrotreating agent. The process is characterized by producing a very small amount of gaseous hydrocarbonaceous products, desulfurizing the carbonaceous feed to the extent of at least about 80%, deasphalting the feed to the extent of at least about 60%, and demetallizing the feed to the extent of at least about 90%. In a preferred embodiment, spent potassium hydroxide is regenerated and recycled to the molten medium.

8 Claims, 1 Drawing Figure

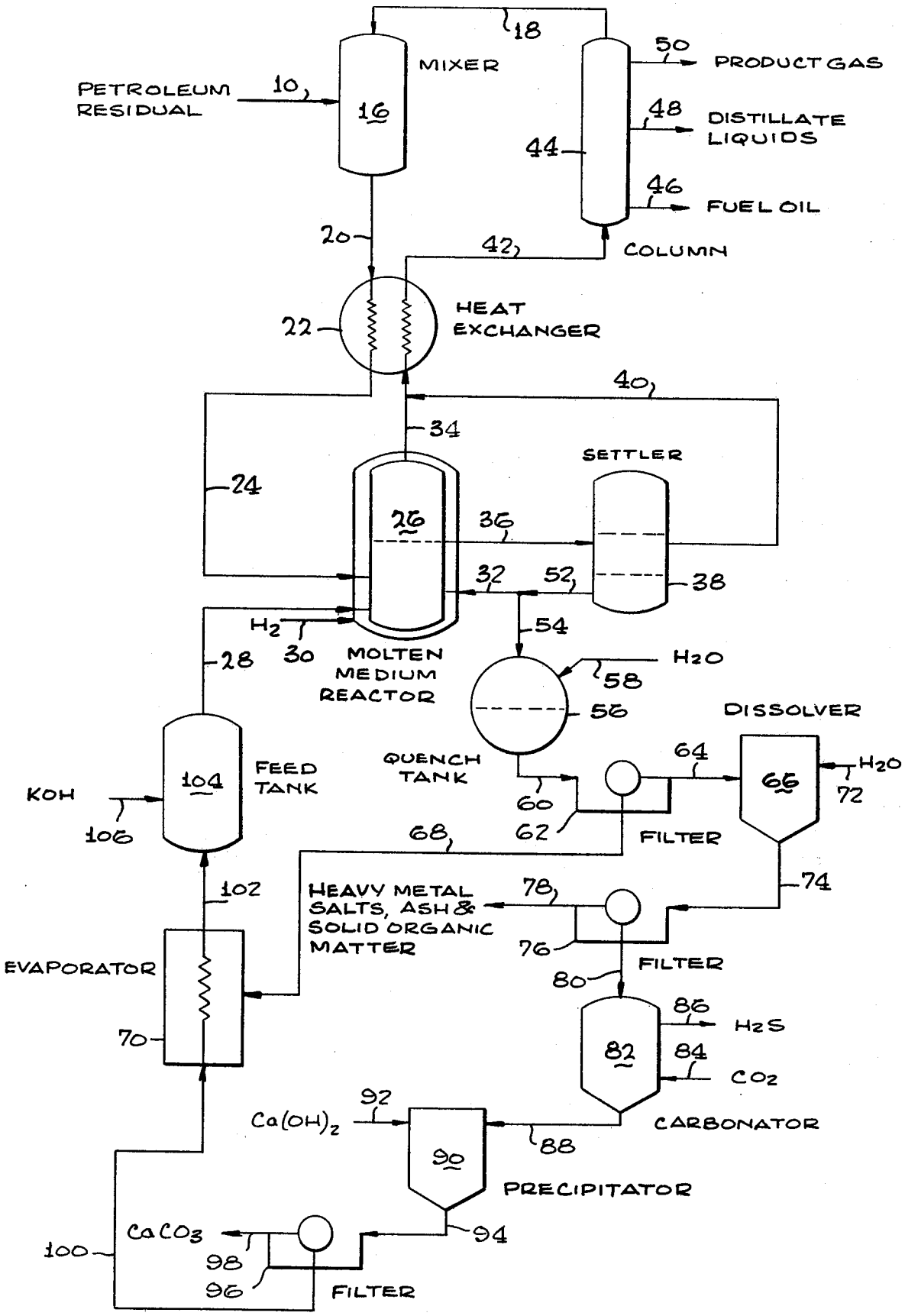
18
MIXER
50
PRODUCT GAS
PETROLEUM RESIDUAL
10
16
48
DISTILLATE LIQUIDS
44
46
FUEL OIL
20
42
COLUMN
22
HEAT EXCHANGER
40
34
SETTLER
24
26
36
32
52
38
H2
30
MOLTEN MEDIUM REACTOR
54
H2O
28
58
56
DISSOLVER
QUENCH TANK
64
H2O
KOH
104
FEED TANK
65
72
106
60
62
FILTER
68
74
102
HEAVY METAL SALTS, ASH & SOLID ORGANIC MATTER
78
76
FILTER
EVAPORATOR
80
86
H2S
70
82
84
CO2
92
Ca(OH)2
CARBONATOR
88
90
PRECIPITATOR
CaCO3
94
100
98
96
FILTER

MOLTEN SALT HYDROTREATMENT PROCESS

BACKGROUND OF THE INVENTION

1. Field of the Invention

The present invention relates to a hydrotreatment process for sulfur, asphaltene and metal removal from petroleum residuals and other carbonaceous materials. In one of its more particular aspects, this invention relates to a process in which desulfurizing, deasphalting and demetallizing reactions occur simultaneously in a reaction zone comprising molten potassium hydroxide and water. In another aspect this invention relates to such a process wherein the potassium hydroxide spent in the hydrotreating reactions is regenerated for reuse in the hydrotreatment process.

2. Prior Art

The steadily increasing demand for distillate petroleum products and the availability of low grade carbonaceous feedstocks such as heavy petroleum residuals, provide incentives for the development of processes for upgrading such feedstocks, which usually contain sulfur, oxygen, and nitrogen as well as various organometallic compounds.

One method of upgrading low grade carbonaceous materials is desulfurization. U.S. Pat. No. 3,164,545, for example, discloses a desulfurization process in which a petroleum fraction is contacted with a molten alkali metal hydroxide containing 5–30% water at a temperature of about 300°–900° F. (150°–480° C.). However, this process merely removes some of the sulfur and other impurities from carbonaceous feedstocks without otherwise improving the quality of such feedstocks.

Another suggested process for beneficiating carbonaceous feedstocks is hydrocracking, which is a decomposition at high pressures and elevated temperatures, with the addition of hydrogen and usually in the presence of a catalyst, such as zeolite, with a platinum, tungsten oxide, cobalt-molybdenum oxide or nickel component. These catalysts may be altered by promotion with another metal or by a pretreatment such as sulfiding. Under these conditions, hydrogenation occurs simultaneously with cracking. Thus, the buildup of tar or coke on the catalyst surface is substantially minimized. A number of problems are involved in these processes, however, including catalyst deterioration caused by the sulfur, nitrogen or ash in the feedstock, presence of hydrogen sulfide in the products and catalyst deactivation resulting from coke and ash deposition on the catalyst surfaces.

It has been proposed that many of these disadvantages can be overcome by a hydrocracking process employing a molten salt as a catalyst. It has been suggested, for example, to use molten zinc chloride or zinc chloride mixed with a zinc oxide acceptor. The use of such molten salt catalyst obviates many problems of the prior art. The catalyst in the form of a molten salt offers a number of advantages, including excellent heat transfer characteristics and continual renewal of fresh catalyst surfaces. In addition, contaminants such as catalyst poisons can be withdrawn with a bleed stream of the molten salt to allow uninterrupted operation. The use of zinc chloride is not without problems, however, since zinc chloride is highly corrosive at elevated temperatures. Further, the solubility of the heavy hydrocarbons in molten zinc chloride is high and makes separation of the organic and salt phases difficult.

In U.S. Pat. Nos. 3,677,932 and 3,736,250 it is suggested that the solubility of hydrocarbons in molten zinc halide may be substantially reduced by the addition thereto of certain alkali metal halides. These processes are not altogether satisfactory, however, because separation of the hydrocarbon products from the salts is incomplete. Further, the regeneration of such mixed salts is a complex procedure requiring high-temperature treatment in a corrosive atmosphere.

In U.S. Pat. No. 3,745,109 there is disclosed a hydrocarbon conversion process in which hydrocarbons such as partially refined petroleum are contacted with a sulfide containing alkali metal carbonate melt. In the presence of hydrogen and at appropriate temperature and pressure conditions, the partially refined petroleum is hydrocracked. This process, although obviating many of the problems of the prior art zinc chloride processes, still is not altogether satisfactory. More particularly, the yields obtainable are lower than is desirable. A commercially viable hydrocracking process should provide a conversion of at least 75–80% of the feedstock. Further, at least about 60% by weight of the product should be obtained as a normally liquid product substantially free of sulfur and metallic ash constituents, such that it is suitable for use as a feed material to a conventional petroleum refinery.

U.S. Pat. No. 3,846,275 suggests a coal liquefaction process which comprises contacting a solid carbonaceous material with a reducing gas, water, and a catalytic compound containing a sulfur component and an alkali metal or ammonium ion at liquefaction conditions to produce a mixture comprising an aqueous phase and a hydrocarbonaceous phase which are separated. The hydrocarbonaceous phase then is extracted with a hydrocarbonaceous solvent to provide an extract fraction, from which the liquefaction product is recovered, and a solid residual fraction.

A similar process is disclosed in U.S. Pat. No. 3,796,650. The suggested process comprises contacting coal with water, at least a portion of which is in a liquid phase, a reducing gas, and a compound selected from ammonia and carbonates and hydroxides of alkali metals, at liquefaction conditions including a temperature of 200°–370° C. to provide a hydrocarbonaceous product. It is a disadvantage of both foregoing processes that the yield of liquid product and amount of feed material converted are less than desirable. In addition, such processes require an aqueous phase reaction. The high temperatures necessarily result in a requirement for excessively high pressures to maintain the aqueous phase.

Another such aqueous process is disclosed in U.S. Pat. No. 3,642,607 wherein a mixture of coal, a hydrogen donor oil, carbon monoxide, water, and an alkali metal hydroxide are heated to a temperature of about 400°–450° C. and under a total pressure of at least about 4000 psig to obtain dissolution of the coal. However, this process suffers from the same disadvantages as the other aforementioned aqueous processes.

U.S. Pat. No. 4,003,823 discloses a process for desulfurization and hydroconversion in the presence of a desulfurizing agent comprising an alkali metal hydroxide. A reaction zone is maintained at a pressure of about 500–5000 psig and a temperature of about 700°–1500° F. (371°–816° C.). The product is a desulfurized, demetallized, and upgraded heavy hydrocarbon feedstock with about 50% of the sulfur being removed by the process. Although providing some advantages, this process suffers from the drawback that substantial amounts of gas and char form during the process.

U.S. Pat. No. 4,092,236 discloses a process for converting coal to cracked products including a major amount of liquid and a minor amount of gaseous and solid products of enriched hydrogen content utilizing a molten salt bath comprising an alkali metal hydroxide, preferably sodium hydroxide. Preferred conditions are a temperature of about 400°-500° C. and a pressure of 50 to 300 atmospheres. Although this process is capable of hydrocracking coal and producing a product mix which has desirable characteristics, the product still contains about 2-10 wt. % of normally gaseous hydrocarbons and 5-30 wt. % of solid hydrocarbonaceous products.

The removal of metals from petroleum products is another method of petroleum residual beneficiation which has been explored. The two most common metals in petroleum crudes and residuals, vanadium and nickel, occur principally in porphyrinic and other organic structures. In crudes which are high in metals content, the vanadium concentration may reach 0.2% and the nickel concentration 0.01%.

U.S. Pat. No. 2,383,972 discloses a process for recovering vanadium from petroleum during the course of a cracking operation which comprises reacting the metallic constituents of petroleum oil, including vanadium, with a solid hydrated sodium aluminum silicate of the zeolite type. Vanadium is recovered from the zeolite by means of solvent treating the zeolite with a strong mineral acid, precipitating the vanadium as ammonium vanadate, roasting the ammonium vanadate to produce the oxide, and reducing the oxide in an electric furnace.

U.S. Pat. No. 2,789,081 discloses a process for the refining of mineral oil which comprises contacting heavy lubricant obtained in a vapor phase refining process with bauxite to remove principally alkali metal contaminants.

U.S. Pat. No. 2,990,365 discloses a process for demetallizing hydrocarbon oils by modifying the properties of complex organometallic compounds, including vanadium organometallics occurring in the oils, by contacting the hydrocarbon oils in the liquid phase with a fused alkali metal hydroxide. The organometallic compounds present are thereby converted to alkali metal salts, which have greater water solubility and can be more easily removed from the hydrocarbon oils than the organometallic compounds.

U.S. Pat. No. 3,936,371 discloses a process for the removal of metal contaminants from heavy hydrocarbon oils by means of treatment with "red mud", a residue which occurs when bauxite is dissolved at high temperatures to provide alumina as a raw material for the electrolytic production of aluminum. Contacting the hydrocarbon oil with the "red mud" at temperatures in the range of about 350°-500° C. in the presence of hydrogen at a pressure of about 1 to 300 atmospheres is said to be highly effective in removing vanadium and other contaminants from the hydrocarbon oil.

U.S. Pat. No. 4,119,528 discloses a process in which simultaneous desulfurization, demetallization and hydroconversion of heavy carbonaceous feeds is accomplished by treatment with potassium sulfide and hydrogen. The process is carried out at a temperature in the range of about 700°-1500° F. (371°-815° C.) and a hydrogen pressure of about 500-5000 psig, but desulfurization is limited.

OBJECTS OF THE INVENTION

It is an object of the present invention to provide a hydrotreatment process which is effective for desulfurizing, deasphalting, and demetallizing various carbonaceous feedstocks.

It is another object of this invention to provide such a process in which desulfurization to the extent of at least about 80% is accomplished.

Another object of this invention is to provide a process in which a very effective removal (at least about 90%) of metals such as vanadium is obtained.

Another object of this invention is to provide a process in which asphaltene content is reduced by about 60%.

It is another object of this invention to provide a process in which coking and gas formation are kept to a minimum level.

It is another object of this invention to provide a process in which the potassium hydroxide used as the hydrotreating agent can be regenerated.

Other objects and advantages of this invention will become apparent in the course of the following detailed description.

SUMMARY OF THE INVENTION

In accordance with the broad aspects of the present invention, a hydrotreating process for sulfur, asphaltene and metal removal from a carbonaceous material is provided. In this process a carbonaceous feedstock such as a petroleum residual is reacted with hydrogen in a reaction zone containing a molten medium comprising potassium hydroxide and water, the water being present in a quantity sufficient to minimize the production of gaseous and solid hydrocarbonaceous products by hydrocracking reactions, but insufficient to significantly reduce the effectiveness of potassium hydroxide as the hydrotreating agent. The desired reactions are conducted by introducing the carbonaceous material, water, potassium hydroxide and hydrogen in an amount sufficient to provide a pressure in the range of about 10 to 300 atmospheres into a reaction zone and maintaining a temperature in the range of about 350°-550° C. within the reaction zone for a reaction time in the range of about 1 minute to 2 hours.

The process of this invention is characterized by producing a product which contains less gaseous carbonaceous products than previously realizable, thereby providing an extremely high yield of useful liquid products. Desulfurization to the extent of 80% and upwards is readily realizable by use of the process of the present invention. In addition at least 60% of the asphaltenes present in the petroleum residual feed are removed. Another advantage of the process of this invention resides in the fact that the metals content of the carbonaceous starting material is reduced to a substantial extent. In particular, metals such as vanadium, the presence of which renders a hydrocarbon product unsuitable for further catalytic refining, are retained in the molten reaction medium and thereby separated from the liquid products recovered from the molten medium reaction zone. It has been found that the vanadium content of a hydrocarbon feedstock is reduced by about 90-98% in accordance with the process of the present invention.

In a preferred embodiment, the spent potassium hydroxide is regenerated in a series of steps including quenching, filtration, carbonation, and causticization and the appropriate water content is maintained by controlled dehydration of the regenerated potassium hydroxide solution.

The invention will be more clearly understood by reference to the detailed description of certain embodiments, which follows, taken in connection with the accompanying drawing.

BRIEF DESCRIPTION OF THE DRAWING

The sole FIGURE of the drawing is a schematic flow diagram of a process for hydrotreating a petroleum residual feedstock and regenerating the potassium hydroxide used in the desulfurizing, deasphalting, and demetallizing reactions constituting a hydrotreating process in accordance with a preferred embodiment of the present invention.

DESCRIPTION OF THE PREFERRED EMBODIMENTS

The present invention provides an improved process for beneficiating carbonaceous materials by a hydrotreating process which results in desulfurization, asphaltene removal and demetallization. In this hydrotreatment process the degree of desulfurization, asphaltene removal and demetallization are higher and the amounts of gaseous and solid hydrocarbons produced are lower than previously attainable.

Various kinds of carbonaceous feedstocks may be used in the process of the present invention. Suitable carbonaceous materials include heavy hydrocarbon feedstocks such as crude oils, heavy residuals such as atmospheric and vacuum residua, crude bottoms, oil shale and tar sand products, pitch, asphalt, and other heavy hydrocarbon pitch-forming residua. In addition, the process of the present invention is applicable to the conversion of coal tar distillates, coal extracts, natural tars, and the like. Especially preferred feedstocks are petroleum residuals and other heavy liquid hydrocarbons. Suitable carbonaceous feedstocks may contain from as low as 1 wt. % up to about 8 wt. % sulfur or more in addition to 0.001–0.2 wt. % metals, various ash constituents, and up to about 30 wt. % asphaltenes.

The process of the present invention is particularly applicable to crude oils, atmospheric and vacuum residua and tars which contain materials boiling above about 350° C. at atmospheric pressure.

The carbonaceous feed material may be introduced into the molten reaction medium without any special pretreatment, may be heated prior to introduction or may be admixed with a solvent, preferably an organic hydrogen donor solvent to stabilize products of the hydrocracking reaction. Such hydrogen donor solvents are well known to those versed in the art. As will be later described, recycle oils obtained from the hydrotreating process of the present invention provide a convenient source of hydrogen donor solvent. Advantageously, the hydrogen donor solvent will be supplied in an amount sufficient to provide a solvent-to-feed ratio of about 1:3 to 5:1. The higher ratios provide the best hydrocracking results. However, a ratio in excess of about 5:1 generally is uneconomical.

The carbonaceous feed material, with or without solvent, potassium hydroxide and water are introduced into a reaction zone containing a molten medium which promotes the desired hydrotreatment. The potassium hydroxide and water may be introduced into the reaction zone independently, or may be introduced as an aqueous solution or mixture, or a suitably hydrated form of potassium hydroxide may be used. For example, potassium hydroxide monohydrate, $KOH.H_2O$ may be advantageously used for this purpose. The potassium hydroxide-water composition is used in an amount ranging from about 50–300 wt. % based on the weight of carbonaceous feed material and preferably about 50–200 wt. %. The water present in the reaction zone minimizes the production of gaseous and solid hydrocarbonaceous products in the hydrotreating reaction. The amount of water used varies from about 16–33 wt. % and preferably about 20–30 wt. %, based on the combined weight of KOH and $H_2O$. Ideally, the KOH and $H_2O$ should be present in a weight ratio corresponding to that of the hydrate, $KOH.H_2O$.

The molten medium may consist of KOH and $H_2O$ without any salts being added or, if desired, may include a minor amount of an alkali metal carbonate. Indeed, in the present process, when the carbonaceous feed material contains oxygen, some of the hydroxide catalyst will be converted to carbonate. The alkali metal carbonate constituent acts primarily as a diluent and provides no significant benefits to the process of the present invention other than decreasing the melting point of the mixture in which the carbonate is contained. However, no significant detrimental effects have been observed with alkali metal carbonate concentrations of up to about 40 wt. % of the molten medium. The sulfur constituents of the carbonaceous feed material will react with and be retained in the molten medium as alkali metal sulfides. In general, the presence of alkali metal sulfides in the molten medium has been found to provide beneficial effects.

In the present process, hydrogen is introduced into the reaction zone in an amount to provide a hydrogen partial pressure in the reaction zone within the range of about 10 to 300 atmospheres and preferably about 30 to 200 atmospheres. Since hydrogen is the principal gas constituent, it is customary to simply monitor the total pressure in the reaction zone rather than determine the actual hydrogen partial pressure. In accordance with the present process, about 0.3–1.5 wt. % hydrogen, and preferably about 0.4–1.2 wt. % based on the weight of the feed material, will be taken up by the carbonaceous feed material. This is significantly less than in prior art processes. The hydrogen may be present in the form of pure hydrogen or a hydrogen-containing gas, which may be obtained from any number of sources including gaseous products of naphtha reformers or hydrogen plants, as well as the off-gases from hydrotreating processes. As will be pointed out below, recycle product gases from the present process may be used for this purpose. The hydrogen-containing gas may contain other gaseous materials such as light hydrocarbons ($C_1$ to $C_3$). It may be introduced into the reaction zone alone or be mixed with the hydrocarbon feed prior to being introduced.

The molten medium hydrogenation reactor utilized in the present process may be any suitable vessel or reactor which can maintain the reactants at the required temperatures and pressures to provide conversion conditions. For example, a conventional autoclave is a suitable reactor for use in a batch operation. A variety of suitable vessels for use as a reactor are known in the art of petroleum hydrodesulfurization or coal liquefaction. Preferably, the hydrogenation zone includes a means for admixing reactants by stirring or other agitation. For example, the desired agitation may be obtained by sparging the molten salt with the gaseous hydrogen or by providing a mechanical stirrer.

The hydrotreating process of the present invention is generally favored by high temperatures and pressures. More particularly, higher temperatures and pressures increase the reaction rate of the reaction between the carbonaceous material and hydrogen. Higher temperatures also promote the cracking of the carbonaceous material. Thus, a temperature of about 350°–550° C. is suitable, and a temperature of about 375°–475° C. is particularly preferred. The pressure within the reaction zone may range from as low as about 10 atmospheres to as high as about 300 atmospheres and preferably about 30 to 200 atmospheres. When the reaction conditions are maintained within the foregoing temperature and pressure ranges, an average residence time of the feed material in the reactor of about 1 minute to 2 hours and preferably about 10 to 100 minutes is sufficient to obtain the desired result. Longer or shorter residence times may, of course, be used depending upon the specific nature of the feed, the degree of conversion desired, and the contact efficiency of the specific reactor system employed.

The conversion products produced in the reaction zone comprise a major amount of desulfurized and demetallized liquid products of reduced asphaltene content having a higher hydrogen content than the feed material. The term "liquid products" as used herein refers to products which are fluid or flowable at 100° C. Generally, at least 80 wt. % and preferably about 90–98 wt. % of the feed material will be converted to such a liquid product of enriched hydrogen content. Desulfurization to the extent of at least about 80% and about 90% demetallization, are also achieved. The asphaltene content generally will be reduced by about 60%. There will be produced a minimum quantity of normally gaseous hydrocarbons as well as some solid hydrocarbonaceous product. The gaseous product may be about 1 wt. % of the products and may range from less than about 1 wt. % to about 2 wt. %. Generally, solids, which may be defined as benzene insoluble materials, constitute no more than about 1–3.5 wt. % of the products. The normally gaseous carbonaceous products may be withdrawn and subjected to a conventional separation technique to recover a synthetic natural gas or methane fraction, an ethane, a propane-butane fraction, and substantially pure hydrogen, which can be recycled to the hydrogenation zone.

The liquid products are suitable for use as a feed material to a conventional petroleum refinery to produce gasoline, kerosene, and other valuable liquid products. Alternatively, liquid products are utilizable as a substantially ash-free, metal-free and sulfur-free fuel of reduced asphaltene content. Depending upon the conditions of the hydrotreatment, the solid products may be similar to the asphalts produced in the conventional processing of crude oils and may be used in a similar manner. Alternatively, the solid products may be char or coke and may be gasified or utilized as fuel as desired.

In one of the preferred embodiments of this invention the potassium hydroxide is regenerated in a process which involves the multiple steps of quenching, filtration, carbonation, causticization, and controlled dehydration. This process involves withdrawing a portion of the spent melt from the molten medium reactor to a gravity separation zone wherein the liquid organic product is separated from a melt phase containing a mixture of molten salts, potassium hydroxide, ash, and solid organic matter. The lower melt phase is either recycled to the reactor or treated to regenerate potassium hydroxide. In general, the ratio of melt phase regenerated to that recycled depends upon the sulfur content of the feedstock and the optimum level of sulfur content in the melt for reactor operation.

The portion of melt phase leaving the gravity separation zone to be treated for potassium hydroxide regeneration is quenched with a limited amount of water or preferably an aqueous potassium hydroxide solution to form a solution of quenched melt containing about 34–50 wt. % water. This solution, which contains potassium hydroxide, potassium carbonate, potassium sulfide and other metal salts is then cooled to about 70° C. and filtered to remove potassium sulfide, other insoluble metal salts, solid organic matter and ash and to recover a concentrated potassium hydroxide solution. The separated solids are dissolved in water and filtered to remove ash, solid organic matter, and vanadium salts. If desired, the solids may be further treated for vanadium recovery. The resulting solution is treated with carbon dioxide to generate hydrogen sulfide and to convert some of the remaining salts to bicarbonates. The hydrogen sulfide can then be further oxidized to elemental sulfur, for example, in a Claus plant, or otherwise utilized as desired. Causticization by treatment of the carbonated solution with calcium hydroxide precipitates calcium carbonate, which can be removed by filtration. The resulting solution, which contains mainly potassium hydroxide, is dehydrated to provide the desired concentration of potassium hydroxide and then mixed with makeup potassium hydroxide and recycled to the reactor for use in the hydrotreating process.

Reference will now be made to the drawing in order to set forth in greater detail the process steps involved in one specific embodiment of the novel hydrotreating process of this invention, utilizing a molten salt bath as the reaction zone and a particular sequence of steps to regenerate the requisite potassium hydroxide. In this embodiment, the carbonaceous feedstock will be exemplified by a petroleum residual. The petroleum residual is fed via a conduit 10 to a mixer 16. Recycled organic hydrogen donor solvent from a source to be described is introduced into mixer 16 via a conduit 18. In mixer 16, recycled hydrogen donor solvent and petroleum residual are mixed to form a solution and heated to 150° C. Alternatively, the residual can be heated to the desired temperature without being mixed with a donor solvent. The resulting solution is removed from mixer 16 via a conduit 20 to a heat exchanger 22, operating at a pressure of 200 atmospheres, wherein the temperature of the solution is raised from 150°–375° C. After passing through heat exchanger 22, the heated solution exits via a conduit 24 and is introduced into a molten medium reactor 26. Molten potassium hydroxide is introduced into reactor 26 via a conduit 28 from a source to be described. Hydrogen is introduced into reactor 26 via a conduit 30 and sparged through the reactor contents. Recirculated spent melt is introduced into reactor 26 via a conduit 32. Reactor 26 operates at a temperature of 425° C. and 200 atmospheres hydrogen pressure. Gaseous products exit reactor 26 via a conduit 34 to heat exchanger 22, where they are cooled from 425° C. to 200° C. Liquid products, solid products and spent melt are removed from reactor 26 via a conduit 36 and conducted to a settler 38. Upon separation in settler 38, an oil layer containing liquid products is removed via a conduit 40, conducted to heat exchanger 22, cooled and then conducted via a conduit 42 to a column 44. In column 44 the cooled products from heat exchanger 22 are separated into various useful fractions including fuel oil, which is separated from column 44 via a conduit 46, distillate liquids, which exit column 44 via a conduit 48 and product gas which is removed from column 44 via a conduit 50. Hydrogen may be separated from the product gas by conventional methods for recycling into molten medium reactor 26, if desired. Organic hydrogen donor solvent for recycle may be removed via conduit 18 to mixer 16, if desired. The melt layer separated from the oil is removed from settler 38 via a conduit 52 which feeds to conduit 32 for recycle to reactor 26. A sidestream of melt is conducted via a conduit 54 to a quench tank 56. Water is introduced into quench tank 56 via a conduit 58. The quenched spent melt, cooled to about 70° C., containing KOH in a 50–66% solution, potassium carbonate, potassium sulfide and heavy metal salts in a slurry phase is removed from quench tank 56 via a conduit 60 and conducted to a filter 62. The precipitate is removed from filter 62 via a conduit 64 and conducted to a dissolver 66. The filtrate from filter 62, principally concentrated KOH solution, is removed via a conduit 68 to an evaporator 70 for processing as described below. Water is introduced into dissolver 66 via a conduit 72 to produce a slurry of solids in salt solution which is conducted via a conduit 74 to a filter 76 where the solids, principally heavy metal salts, ash and solid organic matter are removed via a conduit 78. The heavy metal salts may be further treated for metal recovery. The filtrate from filter 76, comprising a solution of soluble salts, is conducted via a conduit 80 to a carbonator 82 where carbon dioxide is introduced via a conduit 84. Hydrogen sulfide thereby formed is removed from carbonator 82 via a conduit 86 and may be further treated to produce elemental sulfur in a Claus plant if desired. The carbonated solution from carbonator 82 is removed via a conduit 88 to a precipitator 90. Calcium hydroxide is introduced into precipitator 90 via a conduit 92 to precipitate the carbonates as calcium carbonate. The slurry resulting from the introduction of calcium hydroxide into precipitator 90 is removed via a conduit 94 to a filter 96 where solid calcium carbonate is removed via a conduit 98. The filtrate from filter 96, comprising principally an aqueous solution of KOH, is removed via a conduit 100 to evaporator 70. In evaporator 70 the filtrate from filter 96, containing principally KOH in a 60–70% aqueous solution, and the filtrate from filter 62, are partially dehydrated to produce a mixture of potassium hydroxide and water containing about 25 wt. % water, based on the combined weight of potassium hydroxide and water. The partially dehydrated potassium hydroxide exits evaporator 70 via a conduit 102 and is conducted to a feed tank 104. Makeup potassium hydroxide is also introduced into feed tank 104 via a conduit 106. The combined potassium hydroxide feeds are melted in feed tank 104 and introduced into reactor 26 via conduit 28, completing the regeneration and recycle sequence.

Thus, the advantages of the process of the present invention are principally the reduction in the sulfur, asphaltene and metal content of the carbonaceous feedstock, and the production of a high proportion of upgraded liquid products and minimal gaseous and solid products. Further, the molten medium of the present invention, if agitated, allows excellent heat transfer.

The invention will be better understood by reference to the following examples which illustrate embodiments of the processes of this invention and should not be construed as limiting the scope thereof.

EXAMPLE 1

A quantity of 100 grams of a petroleum residual having the elemental analysis shown in Table I and 300 grams of KOH containing 20 wt. % $H_2O$ were introduced into an autoclave, pressurized to 300 psig initial hydrogen pressure and heated to 120° C. The pressure was then raised to 1000 psig and heating was continued to 475° C. Stirring was begun and the pressure was raised to 3000 psig. Stirring continued at this pressure and temperature for a period of 1 hour after which the mixture was allowed to cool to room temperature. The weight and elemental analysis of the products is shown in Table I. The chromatographic analysis of the gaseous products obtained in this experiment is given in Table II.

TABLE I

Elemental Analysis of Reactant and Products? from Petroleum Residual Beneficiation

| Sample | Weight (g) | H (%) | C (%) | H/C | S (%) |
|---|---|---|---|---|---|
| Petroleum Residual Reactant | 100.00 | 10.09 | 81.25 | 1.49 | 4.11 |
| Light Liquid Product | 15.56 | 11.50 | 81.92 | 1.68 | 0.24 |
| Heavy Liquid Product | 70.60 | 10.52 | 79.37 | 1.59 | 0.61 |
| Gas | 0.89 | | | | |
| Losses | 12.95 | | | | |

TABLE II

Gas Chromatographic Analysis of Gaseous Products from Petroleum Residual Beneficiation

| Gas Constituent | Vol (%) | Weight (g) |
|---|---|---|
| $H_2$ | 98.37 | — |
| $CH_4$ | 0.70 | 0.35 |
| $C_2H_6$ | 0.37 | 0.30 |
| $C_3H_8$ | 0.09 | 0.24 |
| Total | — | 0.89 |

This example illustrates the low production of gaseous carbonaceous products, 0.89 wt. %, and the high degree of desulfurization (85%) realized in the process of the present invention.

EXAMPLE 2

The procedure of Example 1 was repeated except that anhydrous NaOH was used instead of KOH and $H_2O$ and the temperature was 450° C. The elemental analysis is shown in Table III. The chromatographic analysis of the gaseous products obtained in this experiment is given in Table IV.

TABLE III

Elemental Analysis of Reactant and Products from Petroleum Residual Beneficiation

| Sample | Weight (g) | H (%) | C (%) | H/C | S (%) |
|---|---|---|---|---|---|
| Petroleum Residual Reactant | 100.00 | 10.09 | 81.25 | 1.49 | 4.11 |
| Light Liquid Product | 30.03 | 10.06 | 82.80 | 1.46 | 0.61 |

TABLE III-continued

Elemental Analysis of Reactant and Products from Petroleum Residual Beneficiation

| Sample | Weight (g) | H (%) | C (%) | H/C | S (%) |
|---|---|---|---|---|---|
| Heavy Liquid Product | 27.57* | ** | ** | ** | 2.88 |
| Gas | 15.40 | — | — | — | — |
| Losses | 27.0 | — | — | — | — |

*Ash-free basis
**Not determined

TABLE IV

Gas Chromatographic Analysis of Gaseous Products from Petroleum Residual Beneficiation

| Gas Constituent | Vol (%) | Weight (g) |
|---|---|---|
| $H_2$ | 80.41 | — |
| $CH_4$ | 10.60 | 5.3 |
| $C_2H_6$ | 4.56 | 4.3 |
| $C_3H_6$ | 0.15 | 0.2 |
| $C_3H_8$ | 2.66 | 3.7 |
| $C_4H_{10}$ | 1.12 | 2.0 |
| Total | | 15.50 |

This example shows that the use of NaOH instead of KOH and $H_2O$ results in greater production of gaseous carbonaceous products, 15.5 wt. % compared to 0.89 wt. % in Example 1, and less desulfurization, 66% compared to 85% in Example 1.

EXAMPLE 3

The procedure of Example 1 was repeated except that dry KOH was used instead of KOH and $H_2O$. In order to ensure that the KOH was dry, 105 grams of petroleum residual was introduced into an additional vessel above the autoclave and the autoclave was filled with 300 g. of commercial grade KOH and heated under vacuum to 430° C. to drive off the $H_2O$, and the $H_2O$ was condensed out in a cold trap. The amount of $H_2O$ condensed was 40 grams. The autoclave was then allowed to cool for 15 hours. The petroleum residual reactant was heated to 162° C. before introducing it into the autoclave. The net weight of the residual feed to the autoclave was 100 g. Hydrogen pressure in the autoclave was adjusted to 1000 psig and the temperature was raised to 450° C. The total pressure was raised to 3000 psig hydrogen and the temperature was maintained for a period of 1 hour. The autoclave was then allowed to cool to ambient temperature, and the gas volume was measured using a wet test meter and the gas composition was determined by gas chromatographic analysis. The gas chromatographic analysis of the gaseous product is shown in Table V.

TABLE V

Gas Chromatographic Analysis of Gaseous Products from Petroleum Residual Beneficiation

| Gas Constituent | Vol (%) | Weight (g) |
|---|---|---|
| $H_2$ | 80.55 | — |
| $CH_4$ | 11.24 | 5.79 |
| $C_2H_4$ | 0.10 | 0.09 |
| $C_2H_6$ | 3.21 | 3.10 |
| $C_3H_6$ | 0.25 | 0.33 |
| $C_3H_8$ | 2.59 | 3.66 |
| iso-$C_4H_{10}$ | 0.44 | 0.82 |
| n-$C_4H_{10}$ | 0.77 | 1.43 |

TABLE V-continued

Gas Chromatographic Analysis of Gaseous Products from Petroleum Residual Beneficiation

| Gas Constituent | Vol (%) | Weight (g) |
|---|---|---|
| iso-$C_5H_{12}$ | 0.15 | 0.36 |
| n-$C_5H_{12}$ | 0.19 | 0.43 |
| Total | — | 16.01 |

This example shows that without water present with the KOH, more gaseous products, 16.01 wt. %, were produced than in the process of the present invention (0.89 wt. % shown in Example 1).

The following example illustrates the upgrading of a petroleum residual by conversion to a predominantly liquid product with an increased hydrogen to carbon ratio, a reduced asphaltene content, and a reduced vanadium content.

EXAMPLE 4

A quantity of 65 grams of a petroleum residual and 65 or 130 grams of KOH containing 25 wt. % $H_2O$ were introduced into a 250 ml Parr autoclave equipped with a shaking mechanism, pressurized to 250 psig initial hydrogen pressure and heated to the desired temperature while being subjected to a fast shaking motion. The pressure was then raised to the desired pressure and the temperature adjusted as necessary. Shaking was continued for a period of 1 hour. The autoclave was quickly cooled to room temperature. The bulk of the oil product was decanted from the solidified melt and the rest was recovered by methylene chloride extraction. The oil was analyzed for C, H, asphaltene and vanadium content to determine the degree of upgrading. The test conditions and analytical results are shown in Table VI.

TABLE VI

Asphaltene and Vanadium Removal Tests with Petroleum Residual

| Sample or Test No. | Test Conditions: Temp. (°C.) | Test Conditions: press. (psig) | Test Conditions: Melt./Resid. Ratio | Test Data: H/C Atom Ratio | Test Data: Asphaltene Removal (%) | Test Data: Vanadium Removal (%) |
|---|---|---|---|---|---|---|
| Residual | — | — | — | 1.44 | — | — |
| 1 | 400 | 1075 | 1/1 | 1.49 | 39.0 | 78.8 |
| 2 | 400 | 2350 | 1/1 | 1.52 | 49.5 | 85.6 |
| 3 | 425 | 2600 | 2/1 | 1.53 | 68.2 | 92.3 |

These results show that asphaltene reduction to the extent of over 60% and vanadium reduction to the extent of over 90% are realizable according to the process of this invention.

Thus, it can be seen that the present invention provides a hydrotreating process in which a carbonaceous feedstock such as a petroleum residual is desulfurized to the extent of at least about 80%, deasphalted to the extent of at least about 60%, demetallized to the extent of at least about 90%, and in which a product is produced which has as little as 1% or less of gaseous hydrocarbonaceous constituents.

It will, of course, be realized that various modifications can be made in the design and operation of the present invention without departing from the spirit thereof. For example, other schemes for regenerating potassium hydroxide from spent melt may be utilized, including separation of ash and char from the spent melt prior to potassium hydroxide regeneration. Thus, while the preferred design and mode of operation of the invention have been explained and what is now considered to represent its best embodiment has been illustrated and described, the invention may be otherwise practiced within the scope of the teachings set forth, as will be readily apparent to those skilled in the art. Accordingly, this invention is not to be limited by the illustrative and specific embodiments thereof, but its scope should be determined in accordance with the appended claims.

What is claimed is:

1. A hydrotreating process for sulfur, asphaltene and metal removal from a carbonaceous material which comprises:

(1) introducing a carbonaceous material and an organic hydrogen donor solvent into a mixing zone;

(2) introducing the resulting solution of carbonaceous material in organic hydrogen donor solvent into a reaction zone containing a molten medium comprising potassium hydroxide and water, said water being present in an amount of about 16–33 wt. % based on the combined weight of said potassium hydroxide and water, said potassium hydroxide and water being present in a combined amount of about 50–300 wt. % based on the weight of said carbonaceous material;

(3) introducing hydrogen into said reaction zone in an amount sufficient to provide a pressure in said reaction zone within the range of about 10 to 300 atmospheres;

(4) reacting said carbonaceous material and hydrogen at a temperature in the range of about 350°–550° C. for a period of time of about 1 minute to 2 hours;

(5) recovering desulfurized, deasphalted and demetallized hydrotreated products comprising about 90–98 wt. % of liquid hydrocarbonaceous products having a sulfur content reduced by at least about 80% from the sulfur content of said carbonaceous material, an asphaltene content reduced by at least about 60% from the asphaltene content of said carbonaceous material, a metals content reduced by at least about 90% from the metals content of said carbonaceous material, and less than about 1 wt. % of gaseous hydrocarbonaceous products;

(6) separating from said liquid hydrocarbonaceous products an organic hydrogen donor solvent;

(7) recycling said organic hydrogen donor solvent to said mixing zone;

(8) removing from said reaction zone a portion of spent molten medium;

(9) adding water to the removed portion of spent molten medium to form an aqueous slurry of solids comprising potassium sulfide, heavy metal salts, ash and solid organic matter in a concentrated aqueous potassium hydroxide solution containing about 34–50 wt. % water;

(10) separating said solids from said concentrated aqueous potassium hydroxide solution;

(11) treating said solids with water to dissolve said potassium sulfide and to leave undissolved heavy metal salts, ash and solid organic matter;

(12) separating said undissolved heavy metal salts, ash and solid organic matter from the aqueous solution resulting from dissolving said potassium sulfide to form a clarified aqueous solution of potassium sulfide;

(13) carbonating said clarified aqueous solution of potassium sulfide to remove hydrogen sulfide therefrom and to produce a carbonated solution comprising potassium carbonate;

(14) reacting said carbonated solution with calcium hydroxide to precipitate calcium carbonate and regenerate an aqueous solution of potassium hydroxide;

(15) separating said calcium carbonate from said aqueous potassium hydroxide solution;

(16) partially dehydrating both said concentrated aqueous potassium hydroxide solution from step (10) and said aqueous potassium hydroxide solution from step (15) to provide a potassium hydroxide solution containing about 16–33 wt. % water; and

(17) recycling said potassium hydroxide solution containing about 16–33 wt. % water to said reaction zone.

2. A process according to claim 1 wherein the solids separated in step (12) are further treated to separate a heavy metal salt concentrate.

3. A hydrotreating process for sulfur, asphaltene and metal removal from a carbonaceous material which comprises:

introducing a carbonaceous material into a reaction zone containing a molten medium comprising potassium hydroxide and water, said water being present in an amount of about 16–33 wt. % based on the combined weight of said potassium hydroxide and water, said potassium hydroxide and water being present in a combined amount of about 50–300 wt. % based on the weight of said carbonaceous material;

introducing hydrogen into said reaction zone in an amount sufficient to provide a pressure in said reaction zone within the range of about 10 to 300 atmospheres;

reacting said carbonaceous material and hydrogen at a temperature in the range of about 350°–550° C. for a period of time of about 1 minute to 2 hours; and recovering from said reaction zone desulfurized, deasphalted and demetallized hydrotreated products comprising about 90–98 wt. % of liquid hydrocarbonaceous products having a sulfur content reduced by at least about 80% from the sulfur content of said carbonaceous material, an asphaltene content reduced by at least about 60% from the asphaltene content of said carbonaceous material, a metals content reduced by at least about 90% from the metals content of said carbonaceous material, and less than about 1 wt. % of gaseous hydrocarbonaceous products.

4. A process according to claim 3 wherein said carbonaceous material comprises a petroleum residual.

5. A process according to claim 3 wherein said molten medium comprises $KOH.H_2O$.

6. A hydrotreating process for sulfur, asphaltene and metal removal from a carbonaceous material which comprises:

(1) introducing a carbonaceous material into a reaction zone containing a molten medium comprising potassium hydroxide and water, said water being present in an amount of about 16–33 wt. % based on the combined weight of said potassium hydroxide and water, said potassium hydroxide and water being present in a combined amount of about 50–300 wt. % based on the weight of said carbonaceous material;

(2) introducing hydrogen into said reaction zone in an amount sufficient to provide a pressure in said reaction zone within the range of about 10 to 300 atmospheres;

(3) reacting said carbonaceous material and hydrogen at a temperature in the range of about 350°–550° C. for a period of time of about 1 minute to 2 hours;

(4) recovering desulfurized, deasphalted and demetallized hydrotreated products comprising about 90–98 wt. % of liquid hydrocarbonaceous products having a sulfur content reduced by at least about 80% from the sulfur content of said carbonaceous material, an asphaltene content reduced by at least about 60% from the asphaltene content of said carbonaceous material, a metals content reduced by at least about 90% from the metals content of said carbonaceous material, and less than about 1 wt. % of gaseous hydrocarbonaceous products;

(5) removing a portion of spent molten medium from said reaction zone;

(6) adding water to the removed portion of spent molten medium to form an aqueous slurry of solids comprising potassium sulfide, heavy metal salts, ash and solid organic matter in a concentrated aqueous potassium hydroxide solution containing about 34–50 wt. % water;

(7) separating said solids from said concentrated aqueous potassium hydroxide solution;

(8) treating said solids with water to dissolve said potassium sulfide and to leave undissolved heavy metal salts, ash and solid organic matter;

(9) separating said undissolved heavy metal salts, ash and solid organic matter from the aqueous solution resulting from dissolving said potassium sulfide to form a clarified aqueous solution of potassium sulfide;

(10) carbonating said clarified aqueous solution of potassium sulfide to remove hydrogen sulfide therefrom and to produce a carbonated solution comprising potassium carbonate;

(11) reacting said carbonated solution with calcium hydroxide to precipitate calcium carbonate and regenerate an aqueous solution of potassium hydroxide;

(12) separating said calcium carbonate from said aqueous potassium hydroxide solution;

(13) partially dehydrating both said concentrated aqueous potassium hydroxide solution from step (7) and said concentrated aqueous potassium hydroxide solution from step (12) to provide a potassium hydroxide solution containing about 16–33 wt. % water comprising regenerated potassium hydroxide and water in amounts suitable for recycling to said reaction zone; and

(14) recycling said regenerated and partially dehydrated potassium hydroxide solution containing about 16–33 wt. % water to said reaction zone.

7. A hydrotreating process for sulfur, asphaltene and metal removal from a carbonaceous material which comprises:

introducing into a reaction zone a carbonaceous material and potassium hydroxide, and water in an amount to provide about 16–33 wt. % water based on the combined weight of said potassium hydroxide and water, said potassium hydroxide and water being present in a combined amount of said 50–300 wt. % based on the weight of said carbonaceous material;

introducing hydrogen to provide a pressure in said reaction zone in the range of about 10 to 300 atmospheres;

maintaining said reaction zone at a temperature in the range of about 350°–550° C. for a reaction time in the range of about 1 minute to 2 hours; and recovering from said reaction zone desulfurized, deasphalted and demetallized hydrotreated products comprising about 90–98 wt. % of liquid hydrocarbonaceous products having a sulfur content reduced by at least about 80% from the sulfur content of said carbonaceous material, an asphaltene content reduced by at least about 60% from the asphaltene content of said carbonaceous material, a metals content reduced by at least about 90% from the metals content of said carbonaceous material, and less than about 1 wt. % of gaseous hydrocarbonaceous products.

8. A hydrotreating process for sulfur, asphaltene and metal removal from a carbonaceous material which comprises:

(1) introducing a carbonaceous material into a reaction zone containing a molten medium comprising potassium hydroxide and water, said water being present in an amount of about 16–33 wt. % based on the combined weight of said potassium hydroxide and water, said potassium hydroxide and water being present in a combined amount of about 50–300 wt. % based on the weight of said carbonaceous material;

(2) introducing hydrogen into said reaction zone in an amount sufficient to provide a pressure in said reaction zone within the range of about 10 to 300 atmospheres;

(3) reacting said carbonaceous material and hydrogen at a temperature in the range of about 350°–550° C. for a period of time of about 1 minute to 2 hours;

(4) recovering desulfurized, deasphalted and demetallized hydrotreated products comprising about 90–98 wt. % of liquid hydrocarbonaceous products having a sulfur content reduced by at least about 80% from the sulfur content of said carbonaceous material, an asphaltene content reduced by at least about 60% from the asphaltene content of said carbonaceous material, a metals content reduced by at least about 90% from the metals content of said carbonaceous material, and less than about 1 wt. % of gaseous hydrocarbonaceous products;

(5) removing a portion of spent molten medium from said reaction zone;

(6) adding water to the removed portion of spent molten medium to form an aqueous slurry of solids comprising potassium sulfide, heavy metal salts, ash and solid organic matter in a concentrated aqueous potassium hydroxide solution containing about 34–50 wt. % water;

(7) separating said solids from said concentrated aqueous potassium hydroxide solution;

(8) treating said solids with water to dissolve said potassium sulfide and to leave undissolved heavy metal salts, ash and solid organic matter;

(9) separating said undissolved heavy metal salts, ash and solid organic matter from the aqueous solution resulting from dissolving said potassium sulfide to form a clarified aqueous solution of potassium sulfide;

(10) carbonating said clarified aqueous solution of potassium sulfide to remove hydrogen sulfide therefrom and to produce a carbonated solution comprising potassium carbonate;

(11) reacting said carbonated solution with calcium hydroxide to precipitate calcium carbonate and regenerate an aqueous solution of potassium hydroxide;

(12) separating said calcium carbonate from said aqueous potassium hydroxide solution;

(13) partially dehydrating both said concentrated aqueous potassium hydroxide solution from step (7) and said aqueous potassium hydroxide solution from step (12);

(14) mixing make-up potassium hydroxide with the partially dehydrated potassium hydroxide solution from step (13);

(15) melting the resulting mixture to provide a molten medium comprising potassium hydroxide and water, said water being present in an amount of about 16–33 wt. % based on the combined weight of potassium hydroxide and water; and

(16) recycling said molten medium to said reaction zone.

* * * * *